United States Patent [19]

Rentzsch et al.

[11] 4,318,329

[45] Mar. 9, 1982

[54] ANTI-TANK WEAPON

[75] Inventors: Max Rentzsch, Röthenbach; Erich Bock, Nuremberg, both of Fed. Rep. of Germany

[73] Assignee: Diehl GmbH & Co., Nuremberg, Fed. Rep. of Germany

[21] Appl. No.: 59,237

[22] Filed: Jul. 19, 1979

[30] Foreign Application Priority Data

Jul. 29, 1978 [DE] Fed. Rep. of Germany ..... 2833390

[51] Int. Cl.[3] ..... F41F 3/04; F41C 27/06

[52] U.S. Cl. ..... 89/1.816; 42/1 F

[58] Field of Search ..... 42/1 Z, 1 F; 89/1.8, 89/1.816, 1.813, 1 R, 1 L; 102/37.3

[56] References Cited

U.S. PATENT DOCUMENTS

| | | | |
|---|---|---|---|
| 1,479,122 | 1/1924 | Wiley | 42/1 F |
| 2,939,449 | 6/1960 | Kortick | 42/1 F X |
| 3,302,522 | 2/1967 | Loureys | 89/1.816 X |
| 3,489,057 | 1/1970 | Tonkin | 89/1.8 |
| 3,507,067 | 4/1970 | Into | 42/1 F X |
| 3,750,529 | 8/1973 | Reed et al. | 89/1.813 X |
| 3,782,021 | 1/1974 | Atchisson | 42/1 F |
| 3,835,749 | 9/1974 | Joneaux | 89/1.8 |
| 4,038,902 | 8/1977 | Welsh | 89/1.816 X |

FOREIGN PATENT DOCUMENTS

| | | | |
|---|---|---|---|
| 337876 | 8/1917 | Fed. Rep. of Germany | 42/1 F |

*Primary Examiner*—David H. Brown

*Attorney, Agent, or Firm*—Scully, Scott, Murphy & Presser

[57] ABSTRACT

Portable anti-tank weapon including a projectile launch tube for firing a projectile at a target. A firing device having at least one firing tube for an illuminating projectile or flare is mounted on the launch tube, with the firing tube being at an angle of elevation relative to the launch tube. A combatant can fire the illuminating projectile or projectiles so as to illuminate to the approach to and the target area, thereby enabling him to sight and fire the anti-tank projectile.

4 Claims, 2 Drawing Figures

ANTI-TANK WEAPON

BACKGROUND OF THE INVENTION

1. Field of the Invention

The present invention relates to an anti-tank weapon including a projectile launch tube.

2. Discussion of the Prior Art

Apparatuses are known which are adapted for the illumination of the approach to or perimeter of a target. However, these cannot be operated in conjunction with anti-tank weapons so that another member of a combat group must be employed for the actuation of the target approach or perimeter illuminating apparatus.

For example, an illuminating projectile or flare which can be utilized for illuminating the approaches to the target area is described in German Laid-Open Patent Application No. 21 44 400. Also known from German Laid-Open Patent Application No. 26 11 206 is an illuminating flare member adapted to be fired from a launching arrangement which is fastened to a helicopter.

SUMMARY OF THE INVENTION

Accordingly, an object of the present invention is to contemplate the provision of an anti-tank weapon by means of which illuminating means can be fired in addition to combat projectiles.

The foregoing object is inventively attained in that there is mounted on the weapon launch tube a firing arrangement with at least one firing tube for an illuminating projectile or flare, and that the firing tube is positioned at an elevational angle relative to the weapon launch tube. The mounting of the flare firing arrangement on the weapon itself affords the advantage that the illuminating apparatus and the weapon can be operated by a single combatant. Through the sighting of the weapon against the target there is concurrently sighted the flare firing tube. Its angle of elevation with respect to the weapon projectile launch tube will ensure that the illuminating projectile will after firing describe a suitable flight path illuminating the target. During the illumination of the target and, respectively the approach area, the combatant has already diverted the anti-tank weapon into normal firing position, in essence, the weapon is directed against the target, and he need only effect minor adjustments in order to achieve an optimum hit against a target.

In a preferred embodiment of the invention, the flare firing arrangement is equipped with two or more firing tubes of the same caliber which are arranged at different angles of elevation relative to the weapon projectile launch tube. As a result, it is also possible to so fire two or more illuminating projectiles or flares as to form an illuminated corridor. A surprising effect is achieved in that, through the differently inclined firing tubes and with the utilization of illuminating projectiles or flares having the same construction, such as caliber, propellant, igniting time point of the illuminating charge, and of the illuminating charge, there is obtained a light corridor in which the concurrently fired illuminating projectiles will ignite at the same elevation. For this purpose, there are to be determined in a simple manner the different angles of elevation of the firing tubes, either empirically or through calculation of the ballistic trajectories of the illuminating projectiles or flares.

In order to render it possible for an anti-tank weapon having a shoulder support for the support of the weapon launch tube to easily absorb the recoil at the firing of the illuminating projectiles, in a preferred embodiment of the invention the firing arrangement is located above the shoulder support.

Pursuant to another aspect of the invention, it is also proposed to incorporate the illuminating projectile firing tubes in current anti-tank weapons through a simple modification. In addition thereto, the storage and the transportation of the illuminating projectile firing arrangement which is attached only in case of need, is without problem.

BRIEF DESCRIPTION OF THE DRAWINGS

An exemplary embodiment of the invention is now described in detail hereinbelow, taken in conjunction with the accompanying drawings; in which.

DETAILED DESCRIPTION

Figure 1:
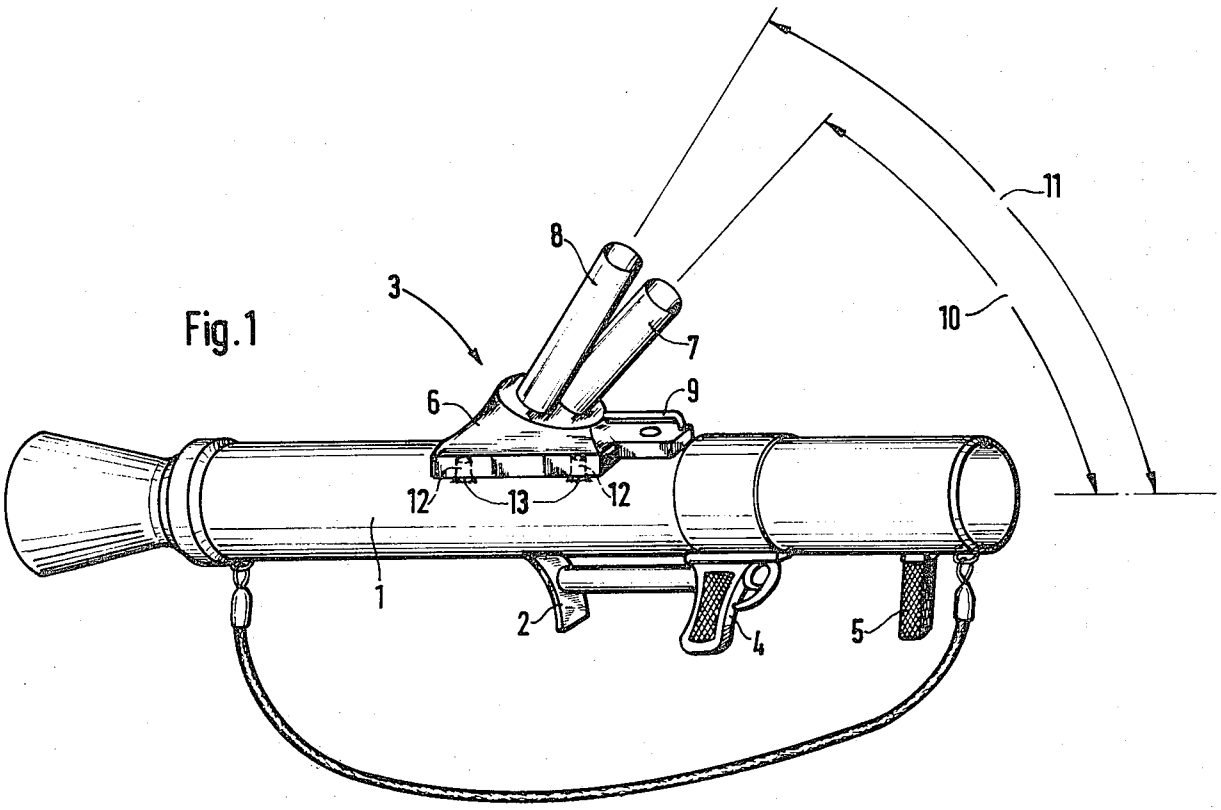
FIG. 1 illustrates an anti-tank weapon with an illuminating flare firing arrangement.
Figure 2:
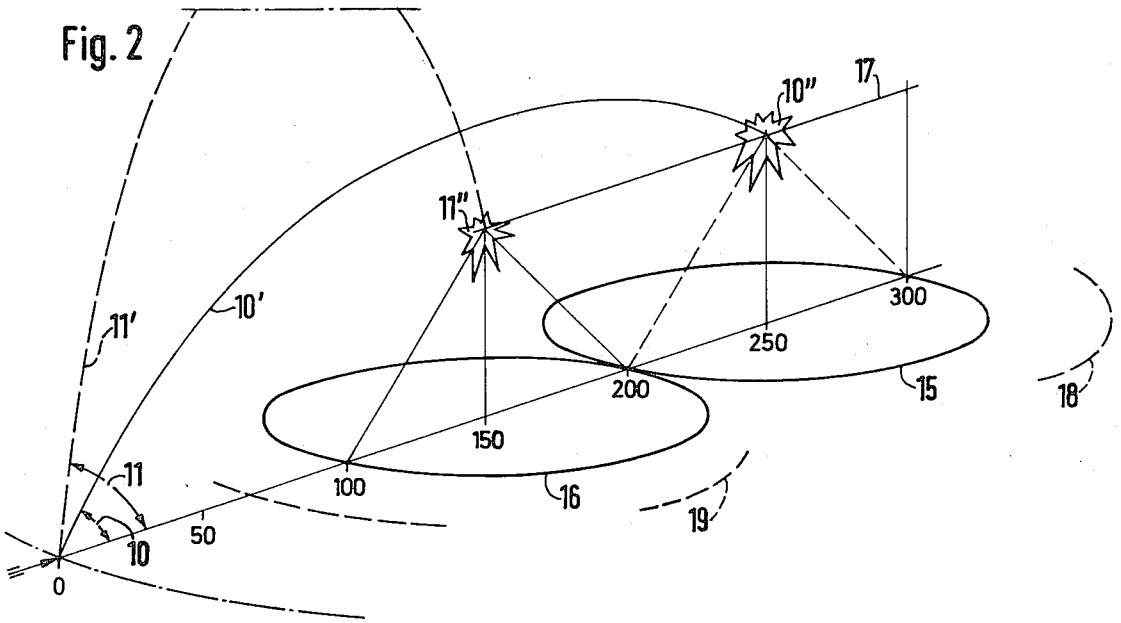
FIG. 2 illustrates the effect of the firing arrangement of FIG. 1.

The portable anti-tank weapon includes a projectile or missile launch barrel or tube 1 having a shoulder support 2 fastened thereto. A firing arrangement 3 is mounted on the launch tube 1 opposite the shoulder support 2. Located ahead of the shoulder support 2 is a trigger member 4 and a grip 5.

The firing arrangement 3 includes a housing portion 6 which is connected with the launch tube 1, from which there project two firing tubes 7 and 8. Located on the housing portion 6 is a trigger arm 9 by means of which there can be triggered the firing means arranged in the housing 6. Furthermore, the housing portion 6 supports projections 12 which latch into corresponding bores 13 on the launch tube 1.

The firing tubes 7 and 8 are so directed as to be positioned at two different angles of elevation 10 and 11 relative to the launch tube 1. The angle of elevation 10 is measured so that an illuminating flare fired from the firing tube 7 will illuminate the intended target area 15 after its ignition. The angle of elevation 11 is measured so that an illuminating flare which is concurrently fired from the firing tube 8 will, after its ignition, illuminate an area 16 lying ahead of and contiguous to the target area 15.

The manner of operation of the described weapon is generally as follows:

Prior to the firing of the illuminating flares, the combatant will target the weapon. Thereafter, by means of the trigger arm 9, there will be concurrently fired the illuminating flares.

The trajectories 10' and 11' are produced for one sort of illuminating projectiles through the mutually different inclinations or slopes of the firing tubes 7, 8. The illuminating projectiles, which are not described in constructive detail, ignite at about the same time at the same elevation 17. The light sources are designated by reference numerals 11'' and 10''. The duration of the illuminating effect consists of 10 to 50 seconds. Hereby, in the middle of the indicated areas 15, 16 there are illuminated minimum radii of about 50 meters. In addition thereto, there is present in the areas 18, 19 at a radius of 75 meters a light intensity of still about 5 lux. The obtained light corridor has a length of about 150 meters. This renders sufficient time and light available to the combatant so as to be able to optimally view a target and to fire an anti-tank projectile.

We claim:

1. Portable anti-tank weapon comprising a projectile launch tube; firing means including at least one firing tube for an illuminating projectile being mounted on said launch tube, said firing tube being at an angle of elevation relative to said launch tube, and said firing means including at least two of said firing tubes having equal calibers and being arranged at different angles of elevation relative to said launch tube.

2. Anti-tank weapon as claimed in claim 1, comprising a shoulder support, said firing means being located above said shoulder support.

3. Anti-tank weapon as claimed in claim 1, comprising separable connecting means for detachably fastening said firing means on said launch tube.

4. Anti-tank weapon as claimed in claim 3, said separable connecting means comprising interengageable latching projections and bores.

* * * * *